United States Patent [19]

Anderson

[11] Patent Number: 4,510,713

[45] Date of Patent: Apr. 16, 1985

[54] WINDOW STRUCTURE

[75] Inventor: Richard N. Anderson, Owensboro, Ky.

[73] Assignee: V. E. Anderson Mfg. Co., Owensboro, Ky.

[21] Appl. No.: 523,677

[22] Filed: Aug. 16, 1983

Related U.S. Application Data

[62] Division of Ser. No. 50,818, Jun. 21, 1979, Pat. No. 4,398,372.

[51] Int. Cl.[3] ..... E05D 15/22

[52] U.S. Cl. ..... 49/175

[58] Field of Search ..... 49/175, 174, 181, 453, 49/455, DIG. 1

[56] References Cited

U.S. PATENT DOCUMENTS

| | | | |
|---|---|---|---|
| 3,676,956 | 7/1972 | Taylor et al. | 49/181 X |
| 3,780,473 | 12/1973 | Kort et al. | 49/DIG. 1 |
| 4,028,849 | 6/1977 | Anderson | 49/453 X |
| 4,064,653 | 12/1977 | Randall et al. | 49/DIG. 1 |
| 4,222,201 | 9/1980 | Yanessa | 49/174 X |

*Primary Examiner*—Philip C. Kannan

[57] ABSTRACT

A universal single hung window including a frame and at least one sash therein movable in the plane of the frame and tiltable about a lower edge thereof out of the plane of the frame, whereby the window may be used as a single hung or a hopper window in one position thereof, and in another position thereof may be used as a glider window. The window structure includes a thermal barrier between a prime window and a storm window. The sash is provided with a balance foot and lower sash guide structure to permit pivoting of the sash about the one edge thereof and support of the sash by a sash balance. Pivoting of the window is permitted on release of tilt release and sash guide mechanism at the upper edge of the sash. The tilt release and sash guide mechanism includes a sash guide member secured to the sash at the upper edge thereof, a tilt release member pivotally mounted on the sash guide member and a spring positioned between the upper sash guide member and tilt release member urging one end of the tilt release member into engagement with the frame.

8 Claims, 34 Drawing Figures

FIG.12
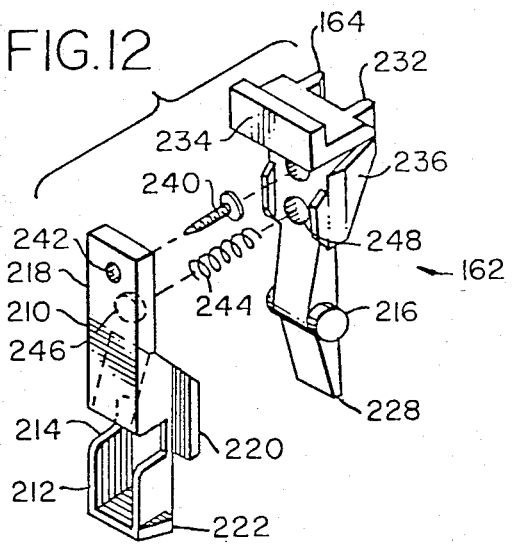
FIG.13
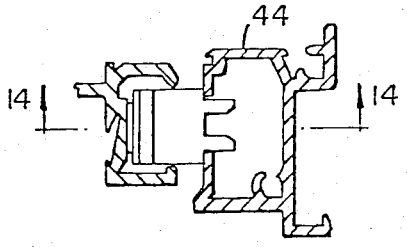
FIG.14
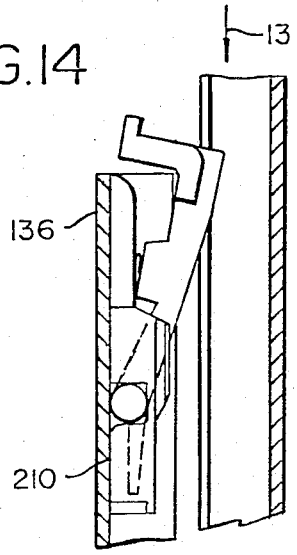
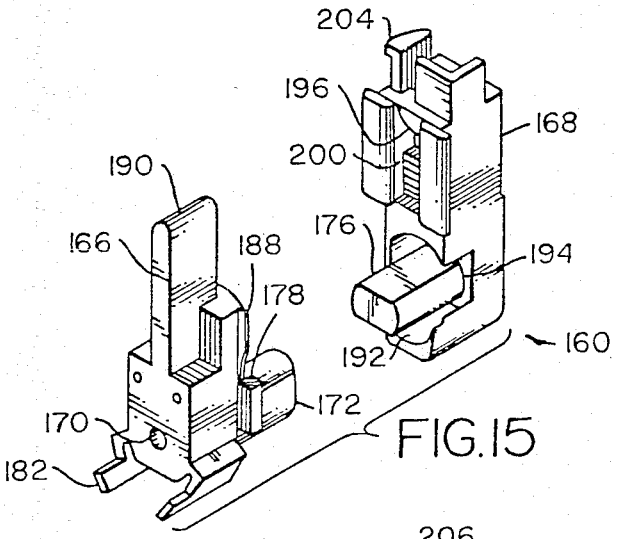
FIG.15
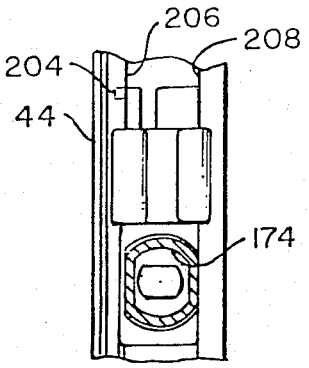
FIG.17
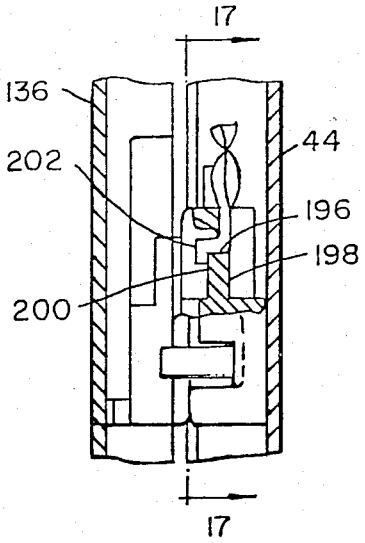
FIG.16

FIG. 29
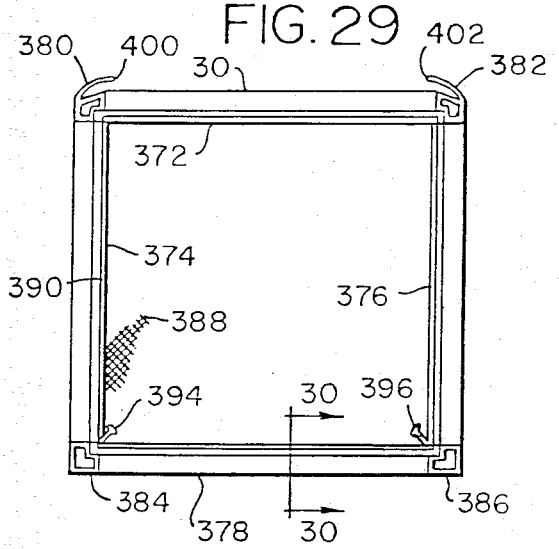
FIG. 30
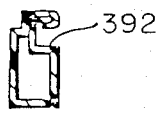
FIG. 31
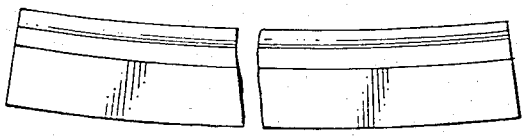
FIG. 32
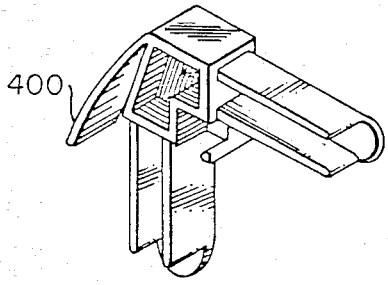
FIG. 33
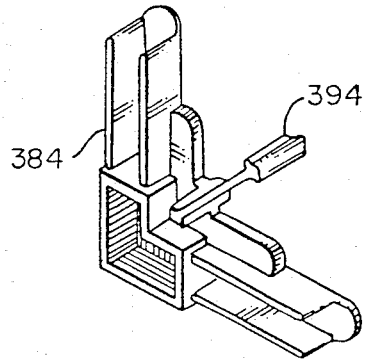
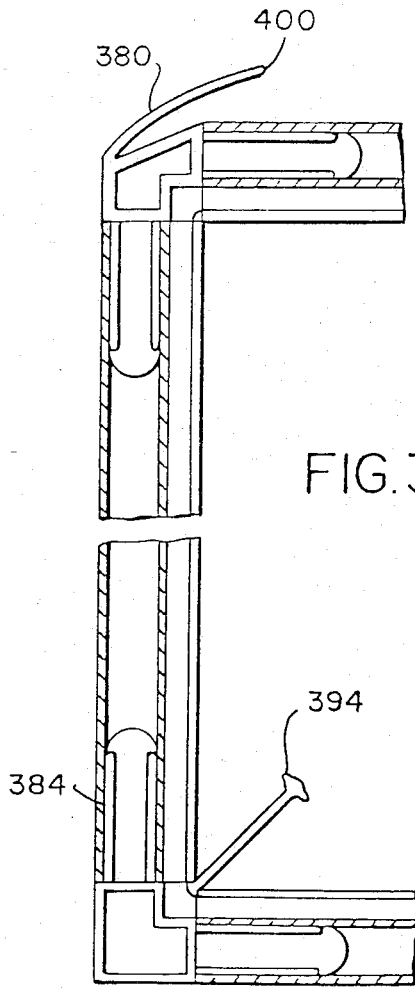
FIG. 34

WINDOW STRUCTURE

This is a division of application Ser. No. 050,818, filed June 21, 1979, issued as U.S. Pat. No. 4,398,372, on Aug. 16, 1983.

BACKGROUND OF THE INVENTION

Field of the Invention

In the past, separate window structures have generally been provided for installation as single hung, hopper and/or glider windows. Wherein a single hung window structure has been utilized for installation as a single hung, hopper and/or glider window, they have generally been relatively complicated and therefore difficult to construct and install, and have often been inefficient in their installation as one or more of these three types of windows.

In particular, such window structures of the past have usually not included a thermal barrier. Wherein thermal barriers have been included in window structures in the past, they have usually either not provided an adequate thermal barrier or have not been sufficiently rigid. In addition, thermal barrier structure of the past has often been complicated and therefore difficult and expensive to manufacture.

Prior window structures, wherein a storm window has been provided in conjunction with a prime window, have usually required separate operation of the prime windows and the storm windows. Wherein simultaneous operation of prime and storm windows have been provided in the past, it has not usually been selective. Further, simultaneous operation of prior prime and storm windows has not generally been possible with simple, easy to construct, inexpensive and efficient structure.

Also, with the window structures of the past, wherein tilt release and upper sash guide structure has been provided, the structure has also often been complicated and inefficient. Further, the tilt release structure of the past has often required manual operation and has not been adapted to automatic operation such as is necessary in conjunction with automatic sash ejector structure.

Balance foot structure of the past has often required special connecting means for a sash balance connected thereto, required complicated structure for holding the balance foot in a predetermined position on relative tilting of the associated sash and frame, has transferred unnecessary torque to the frame during operation of the window sash, and further has twisted unnecessarily with the sash removed from the frame.

Lower sash guide structures in conjunction with balance feet of the past have not usually transferred torque effectively between the balance feet and the window sash and have been inefficient in locking the balance feet in a predetermined position in the window frame on tilting of the sash in the frame.

In prior window structures, the window sash side stiles are often set in grooves in the window frame jambs. Wherein the sash side stiles are not in engagement with the jambs in prior structures, the weather stripping between the sash side stiles and frame jambs has not always been efficient in preventing wind and moisture movement therethrough.

Prior window structures have often included locks for securing window sash in a fixed closed position within a window frame. The lock structure has not, however, always been readily visible, easily operated or particularly efficient in effecting the locking and unlocking function desired.

Structure for securing a window sash in predetermined open or partly open positions has not always been included in prior window structure. Further, wherein such structure has been provided in the past, it has required separate manual operation during opening and/or closing of the window.

Wherein window structures of the past have been provided with a sash which has been movable in the plane of the window frame and tiltable out of the plane of the frame, such structures have generally required separate operation of a tilt release mechanism or the like during pivotal movement of or prior to pivotal movement of the window out of the plane of the window frame. No prior automatic sash ejector structure is known. Accordingly, no structure for preventing operation of automatic sash ejector structure on movement of a sash in a window frame is known.

Prior window screen structure has generally included L-shaped corner brackets for receiving mitered stiles which stiles have in the past been straight between corners. Screen structure of the past has sometimes been held together by screen material secured to the stiles. Separate spring means and/or lift tabs have often been applied in the past to screen structures.

SUMMARY OF THE INVENTION

In accordance with the invention, there is provided window structure including a generally rectangular frame having one fixed and one movable prime sash therein. The movable prime sash is movable both in the plane of the window structure between the opposite ends of the window frame jambs toward and away from the head and sill of the window frame. The prime sash of the invention is further tiltable about the lower edge thereof out of the plane of the window frame. Such window structure may be installed in an upright position as a single hung window or a hopper window, or may be installed on its side as a glider window. Such single hung window structure thus limits the need for separate inventories of single hung, hopper or glider windows.

The frame of the window structure includes an outer rectangular frame and an inner rectangular frame which are separated by a thermal barrier. The thermal barrier extends through the window frame between inner and outer frame portions and is offset in passing through the window frame between the inner and outer frame members. Further, the thermal barrier extends transversely to the plane of the window frame a substantial distance in surface to surface contact with both the inner and outer frame portions, whereby the desired thermal barrier is created while desired rigidity is maintained.

The thermal barrier may be snapped in position between the inner and outer frame portions, or the inner and outer frame portions may be roll formed with the thermal barrier in position therebetween. The thermal barrier may be increased in thickness and/or may be made hollow, as required by a particular installation and insulating value and stiffness required.

The window structure of the invention further includes a storm window having a fixed upper sash and a lower sash movable in the plane of the window frame. Sash adapter structure is provided for selectively connecting the movable sash of the prime window and the movable sash of the storm window for movement in the plane of the window structure together.

The prime sash of the window structure is pivotally mounted about one edge thereof by a cooperating separate balance foot and lower sash guide member at each frame jamb. The lower sash guide member includes pivot means extending into the balance foot for pivotally mounting the prime sash. The balance foot includes means for securing a torsion balance ribbon having an offset thereon to the balance foot without tools or additional structure and is constructed to transfer torque to the lower sash guide member when in engagement therewith and to reduce twist of the balance foot when it is disengaged from the lower sash guide member. The sash balance foot and lower sash guide structure cooperate on pivoting of the window to wedge a portion of the sash guide and a portion of the balance foot in a channel in the associated window frame jamb to maintain the window sash in predetermined position along the frame jamb on pivoting thereof.

Tilt release and upper sash guide structure are secured to the window sash at the upper or other edge thereof adjacent the window frame jambs and include spring biased tilt release structure secured to the window sash by the upper sash guide structure, while tilt release structure extends within a channel in the window frame jambs to guide the movement of the window sash in the plane of the window frame and to permit tilting of the other edge of the window sash out of the plane of the window frame on withdrawal of the tilt release structure from the frame jamb channel and subsequent pivoting of the window about the lower or one edge thereof.

In the closed position of the window sash, weather strip structure is secured to the window frame jamb and extends over the side stiles of the movable prime sash. The jamb weather strip structure includes a relatively soft sealing portion, a relatively hard portion for securing the weather strip to the frame jamb, and a relatively soft portion for seating on the frame jamb and sealing between the frame jamb and prime window stiles.

A sash lock is pivotally secured centrally to the window frame jamb structure, which in one pivoted position thereof prevents movement of the window sash from a closed position, and in another relatively pivoted position permits movement of the sash in the plane of the window frame. The sash lock is spring biased to remain in either open or closed positions, or alternatively may be biased to provide automatic locking each time the sash is closed.

Pendulum lock structure is provided in the window structure which includes a pendulum member secured to the prime window sash and at least one camming and locking tab secured to the window frame, whereby on raising of the prime window sash to move the pendulum member past the camming and locking tab, the pendulum member is pivoted away from the tab to permit raising of the window. On lowering of the prime sash rapidly, the pendulum member is again pivoted away from the tab to permit full closing of the prime sash. However, on lowering of the sash slowly, the pendulum member rigidly engages the tab to hold the prime window in a predetermined partly open position.

Sash ejector structure is secured to the window frame of the window structure of the invention adjacent the frame head and includes means for first releasing the tilt release structure of the movable prime sash and then camming the upper edge of the movable sash out of the plane of the window frame on movement of the movable prime sash into a predetermined position with respect to the window frame.

A lever type stop which may be pivoted into and out of locking engagement with the window sash as it is moved toward the sash ejector structure is provided to selectively prevent pivoting of the other edge of the prime sash out of the plane of the window frame.

A window screen is provided in conjunction with the prime window and storm window in the window structure of the invention which includes side stiles having squarecut ends secured together by corners, some of which include integral spring means and others of which include integral lift tabs. In addition, at least some of the side stiles of the screen frame are bowed outwardly of the screen frame and function to stress screen material placed in the screen frame on the screen material being placed in the frame with the side stiles held straight when the stiles are subsequently released to attempt to resume their bowed configuration.

BRIEF DESCRIPTION OF THE DRAWINGS

FIG. 12 is a perspective view of the tilt release and upper sash guide structure of the window structure illustrated in FIGS. 1 and 2.

FIG. 13 is a section view of a portion of the frame jamb and side stile of the movable prime sash of the window structure illustrated in FIGS. 1 and 2, showing the tilt release and sash guide of FIG. 12 installed in the window structure of FIGS. 1 and 2 from the top thereof, as illustrated by arrow 13 in FIG. 14.

FIG. 14 is a section view of the portion of the frame jamb and sash side stile of the window structure of FIGS. 1 and 2 illustrated in FIG. 13, taken on the line 14—14 in FIG. 13, again showing the tilt release and sash guide structure in assembly therein.

FIG. 15 is a perspective view of the balance foot and lower sash guide of the window structure illustrated in FIGS. 1 and 2.

FIG. 16 is a longitudinal section view of a portion of the prime sash jamb and the sash side stile of the window structure illustrated in FIGS. 1 and 2, showing the balance foot and lower sash guide in assembly therewith.

FIG. 17 is a section view of the balance foot and lower sash guide structures shown in FIGS. 15 and 16, taken substantially on the line 17—17 in FIG. 16.

FIG. 29 is an elevation view of the screen structure of the window structure illustrated in FIGS. 1 and 2.

FIG. 30 is an enlarged section view of the screen structure illustrated in FIG. 29, taken substantially on the line 30—30 in FIG. 29.

FIG. 31 is an enlarged broken elevation view of one of the side stiles of the screen structure illustrated in FIG. 29, showing an exaggerated, slight bow applied to the screen side stiles during their manufacture.

FIG. 32 is a perspective view of an upper corner bracket of the screen structure illustrated in FIG. 29.

FIG. 33 is a perspective view of the lower corner bracket of the screen structure illustrated in FIG. 29.

FIG. 34 is an enlarged, partly broken away portion of the screen structure of FIG. 29.

DESCRIPTION OF THE PREFERRED EMBODIMENT

Figure 1:
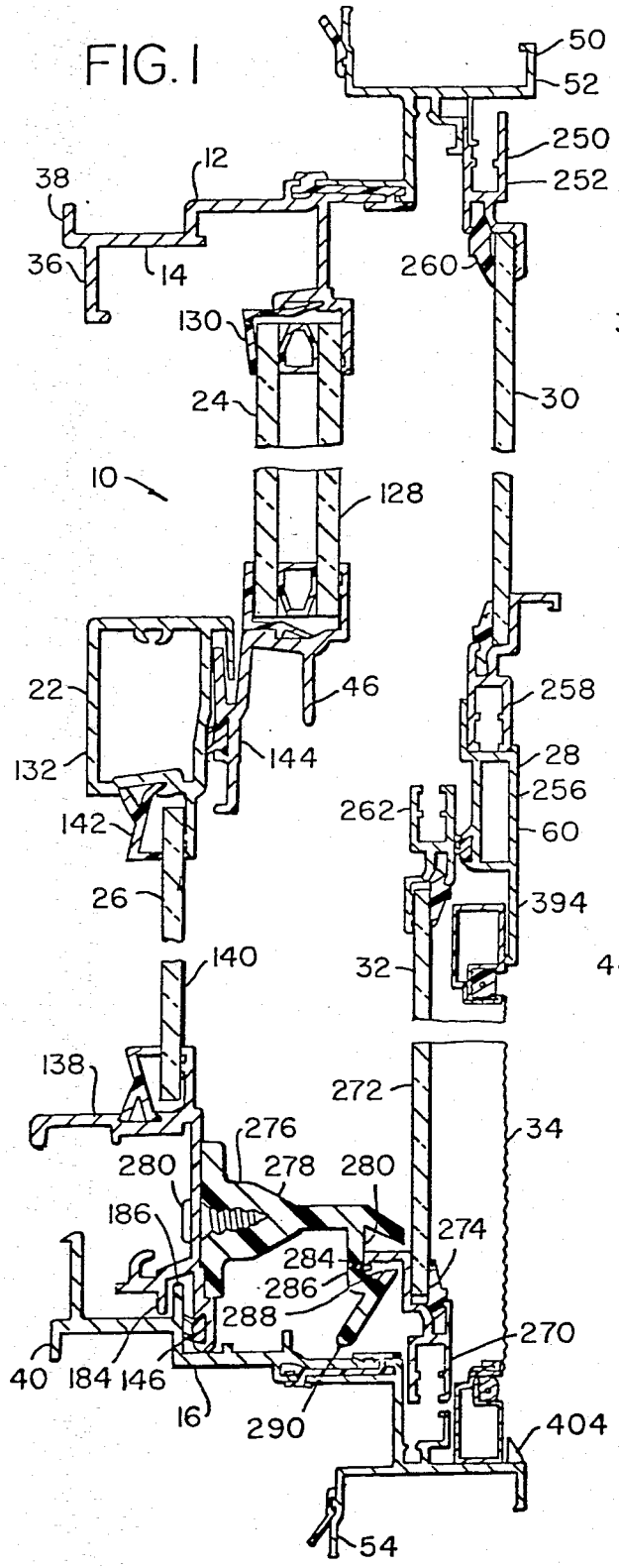
FIG. 1 is a broken longitudinal section view of window structure constructed in accordance with the invention, including both thermal barrier structure and a sash coupler in conjunction therewith.
Figure 2:
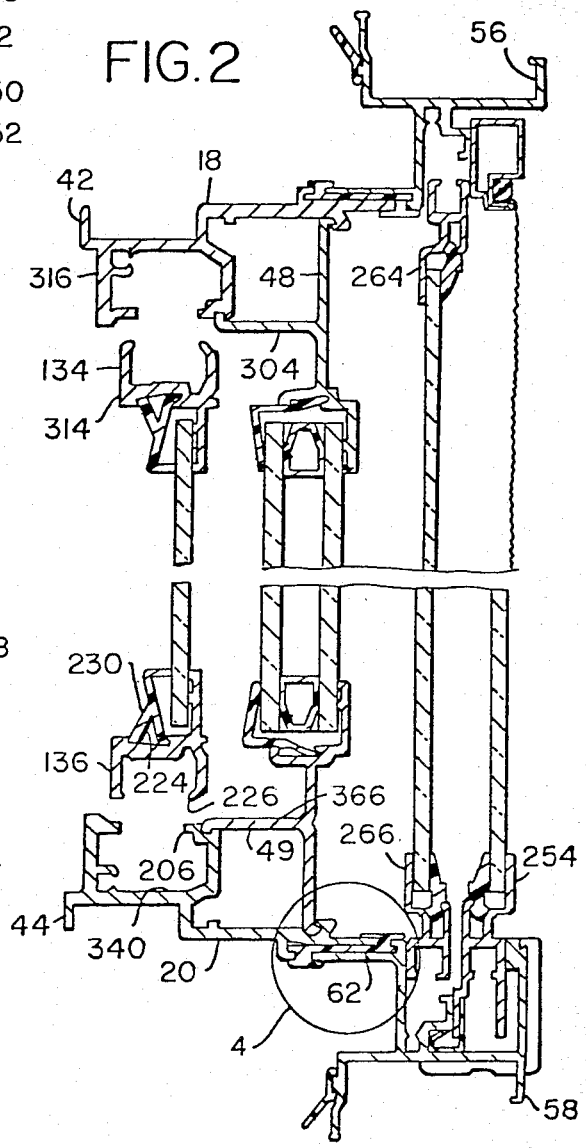
FIG. 2 is a broken horizontal section view of the window structure illustrated in FIG. 1 showing both the upper storm window sash structure and the window screen structure in separate portions thereof.

The window structure 10, best shown in FIGS. 1 and 2, includes a frame 12 having a head 14, sill 16, and jambs 18 and 20. A prime window 22 including a fixed sash 24 and a movable sash 26 and a storm window 28 including a fixed sash 30 and a movable sash 32 are secured in the frame 12. A screen 34 is also positioned in the frame 12.

In operation, the movable sash 26 of the prime window 22 may be moved between the sill 16 and head 14 along the jambs 18 and 20 and may be pivoted about its lower edge into and out of the plane of the frame 12. The storm sash 32 may also be moved in the plane of the frame 12 between the head 14 and sill 16.

More specifically, the frame 12 includes a separate inner portion 36, again including head, sill and jamb members 38, 40, 42 and 44, and the inner frame portion 36 further includes the check rail 46 and the jamb adapter members 48.

All of the members of the inner frame portion 36 may be constructed of extruded aluminum and have the cross sections shown in FIGS. 1 and 2. The head, jamb and sill members 38, 40, 42 and 44 are miter-cut at their corners and are secured together by convenient means such as screws, not shown. The check rail 46 is square-cut and is connected to the jamb members centrally thereof at the opposite ends of the check rail, again by convenient means such as screws, not shown. The jamb adapter members 48 are square-cut at their ends and extend between the head member 38 and check rail 46. The jamb adapter members 48 are secured to the jamb members 42, 44 by the inner fitting portions of their cross sections, as shown best in FIG. 2.

Frame 12 further includes the outer frame portion 50, again including head, sill and jamb members 52, 54, 56 and 58. The outer frame portion 50 further includes the check rail 60. Again, the head, sill and jamb members of the outer frame portion 50 have mitered corners secured together by convenient means such as screws, not shown, and the check rail 60 has square-cut ends connected to the outer frame portion jamb members centrally thereof. The members of the outer frame portion may also be aluminum extrusions having the cross sections shown.

The frame 12 further includes the thermal barrier member 62 which is positioned between the inner and outer frame portions 36 and 50, respectively. The thermal barrier member 62 extends between the inner frame portion 36 and the outer frame portion 50 around the entire frame 12 and is effective to greatly reduce thermal conductivity between the inside and outside of the window 10 through the frame 12.

The thermal barrier member 62, which may be a neoprene extrusion, and the portions of the inner frame portion and outer frame portion, which are connected together to form a single rigid frame 12, are best shown enlarged in FIGS. 4–8 in a plurality of modifications thereof. The thermal barrier member 62 shown in FIGS. 1 and 2 is the same as the thermal barrier member 62 shown in FIG. 4.

Figure 4:
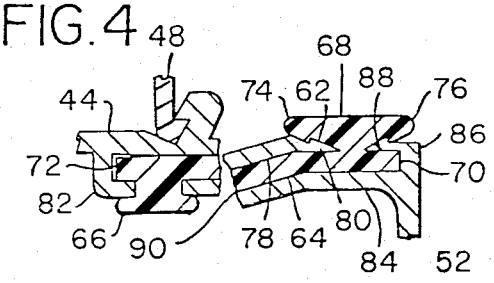
FIG. 4 is an enlarged section view of the thermal barrier structure of the window structure illustrated in circle 4 in FIG. 2, showing the inner and outer frame portions and thermal barrier member staked together.

As shown in FIG. 4, the thermal barrier member 62 has a cross section which includes an elongated portion 64 extending transversely of the plane of the window frame 12. The thermal barrier member 62 further includes H-shaped portions 66 and 68 at each end of the elongated portion 64 thereof. The side 70 of the H-shaped portion 68 of the cross section of the thermal barrier member 62 and the side 72 of the H-shaped portion 66 of the cross section are in line and are extensions of the elongated section 64 of the thermal barrier member 62, again as shown best in FIG. 4. Barbed ends 74 and 76 are provided on the other side of the H-shaped cross section portion 68.

The frame jamb 44 of the inner frame 36, as shown best in FIG. 4, is provided with the extension 78 which is terminated in a barb 80 and further includes the L-shaped cross section portion 82, as shown best in FIG. 4. The jamb 56 of the outer frame 50 includes the cross section extension 84 and the L-shaped portion 86, which L-shaped portion is terminated in the barbed end 88.

In assembly of the inner frame portion 36 and outer frame portion 50 with the thermal barrier member 62, as shown in FIG. 4, the barbed ends 74 and 80 and 76 and 88 secure the frame portions and thermal barrier member together. If it is desired to additionally secure the frame portions and barrier member together, the assembled frame portions and barrier member are staked intermittently around the periphery thereof to provide staked-out portions 90, as shown in FIG. 4.

With the inner and outer frame portions 36 and 50 and the thermal barrier member 62 so assembled, it will be noted that surface to surface contact over a wide area transversely of the window frame 12 is accomplished. Also, the thermal barrier through the frame 12 is offset. Thus, the assembled frame portions 36 and 50 and the thermal barrier 62 are particularly rigid in assembly.

Further, the complete separation of the inner frame portion 36 from the outer frame portion 50 by the thermal barrier member 62 provides the necessary thermal barrier between the inside and outside of the window structure 10.

Figure 5:
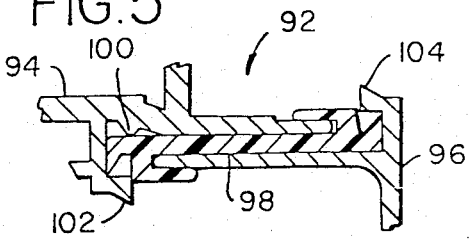
FIG. 5 is an enlarged cross section of the thermal barrier structure of the window structure illustrated in FIGS. 1 and 2, showing the inner and outer frame in assembly, with the thermal barrier member prior to the inner and outer frame being roll formed to secure the inner and outer frame portions and thermal barrier member together.
Figure 6:
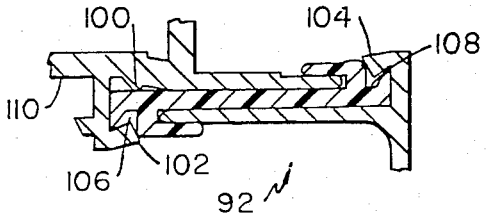
FIG. 6 is a section view of the window structure shown in FIGS. 1 and 2 similar to FIG. 5 after the roll forming of the inner and outer frame portions has been accomplished.

In the modified thermal barrier structure 92 illustrated in FIGS. 5 and 6, the inner frame portion 94, the outer frame portion 96, and the thermal barrier member 98 have the cross sections shown in FIG. 5. In particular, the rib 100 on the inner frame portion 94 should be noted, along with the portions 102 and 104 of the cross sections of the inner frame portion 94 and outer frame portion 96, which are to be roll formed in securing the frame portions 94 and 96 to the thermal barrier member 98.

As shown in FIG. 6, the portions 102 and 104 of the inner frame portion 94 and the outer frame portion 96 are roll formed in assembly to extend into the pockets 106 and 108 of the thermal barrier member 98. In the modified structure shown in FIGS. 5 and 6, the rib 100 cooperates with the portion 102 of the inner frame member 94 to clamp the end 110 of the thermal barrier member 98 therebetween.

Again, the assembled inner frame portion 94 and outer frame portion 96 and thermal barrier member 98, as shown in FIG. 6, provides an offset thermal barrier which completely separates the inner frame portion 94 from the outer frame portion 96, and as before, provides substantial surface to surface contact in a plane extending transverse to the plane of the completed window frame, whereby rigidity of the window frame is maintained with the required thermal barrier.

Figure 7:
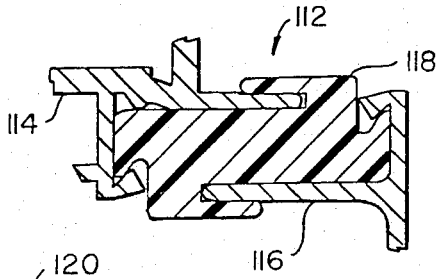
FIG. 7 is a section view similar to the section views of FIGS. 5 and 6, with the thickness of the thermal barrier member increased to increase the thermal barrier provided thereby.

In the further modified thermal barrier 112 shown in FIG. 7, the inner frame portion 114 and the outer frame portion 116 are modified in cross section as shown to receive a thickened thermal barrier member 118. The thermal barrier structure 112 provides additional thermal separation of the frame portions 114 and 116. The thermal barrier 118 may be varied in size as required to meet thermal barrier requirements.

Figure 8:
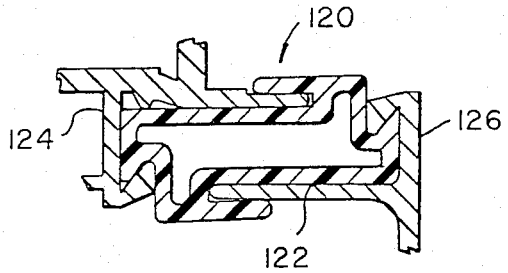
FIG. 8 is a section view similar to that of FIG. 7 but with the thermal barrier member being made hollow to further increase the thermal barrier characteristics thereof.

The thermal barrier structure 120 illustrated in FIG. 8 is the same as the thermal barrier structure illustrated in FIG. 7, except that the thermal barrier member 122 is hollow in cross section as shown. The hollow thermal barrier member 122 provides a greater thermal barrier between the frame portions 124 and 126.

The fixed sash 24 of the prime window 22 includes a panel of insulating glass 128 secured between the head 38, jamb adapter members 48 and 49, and check rail 46 of the inner frame portion 38 by glazing vinyl strips 130 having the cross section shown best in FIGS. 1 and 2.

The movable sash 26 of the prime window 22 includes a sash check rail 132, sash stiles 134 and 136 and sash lift rail 138 having the cross section shown in FIGS. 1 and 2. A single glass panel 140 is secured in the movable sash 22 by the vinyl glazing strips 142 having the cross section shown. Weather stripping members 144 and 146 are operable between the fixed check rail 46 and the sash check rail 132 and between the sash lift rail 138 and sill 40, as shown best in FIG. 1.

Figure 3:
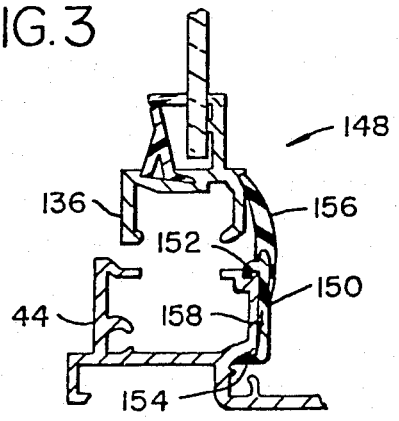
FIG. 3 is an enlarged section view of the jamb weather strip structure of the window structure of FIGS. 1 and 2.

Jamb weather strip structure 148, as best shown in FIG. 3, extends between the jamb members 42 and 44 of the inner frame portion 36 and the sash stiles 134 and 136 of the movable sash 26, with the movable sash in the closed position as shown in FIG. 2. The jamb weather strip structure 148 extends from the sill 40 to the fixed check rail 46 of the inner frame portion 36.

As shown best in FIG. 3, the jamb weather strip structure 148 is a dual durometer plastic extrusion including a relatively rigid part 150 having a U shape, the ends of which terminate in hook portions 152 and 154. The hook portions 152 and 154 cooperate with the cross section of the jambs 42 and 44 to secure the weather strip structure 148 to the jambs 42 and 44 in the manner shown best in FIG. 3. The jamb weather strip structure 148 further includes a relatively flexible portion 156 extending from one side of the cross section of the relatively rigid portion 150 across the gap between the jambs 42 and 44 and sash stiles 134 and 136, again as shown best in FIG. 3, into engagement with the stiles 134 and 136 to seal between the jamb 42 and stile 134 and the jamb 44 and stile 136.

The jamb weather strip structure 148 further includes a relatively flexible portion 158 extending from the connecting U-shaped relatively rigid portion 150. The portion 158 of the jamb weather strip structure biases the relatively rigid member 150 so that the barbs 152 and 154 securely engage the jambs 42 and 44. The portion 158 also aids in preventing leakage between the jambs 42 and 44 and the relatively rigid portion 150 of the jamb weather strip structure.

The movable sash 26 in the prime window 22 may be moved in the plane of the window frame 12 with the sash stiles 134 and 136 guided along the jamb portions 42 and 44 of the inner frame portion 36 by the balance foot and lower sash guide structure 160 shown best in FIGS. 15–17 and by the tilt release and upper sash guide structure 162 illustrated best in FIGS. 12–14. The movable sash 26 may also be pivoted out of the plane of the window frame 12 about the sash lift rail 138 on actuation of the tilt release member 164 of the tilt release and upper sash guide structure 162.

The balance foot and lower sash guide structure 160 includes the separate balance foot member 166 and balance foot member 168 illustrated best in FIG. 15. The bottom sash guide member 166 is secured within the sash stiles 134 and 136 at the bottoms thereof adjacent the ends of the sash lift rail 138 which are square cut to abut the sash stiles 134 and 136. The bottom sash guide member 166, as shown in FIG. 15, is secured to the sash stile 136 by convenient means such as a screw, not shown, extending through the opening 170 therein and through the sash stile 136 into the lift rail 138. The bottom sash guide 166 includes the pivot portion 172 extending out of the sash stile 136 and into the frame jamb 44, as shown in FIG. 16. The pivot portion 172 has the recess 174 therein shown in FIG. 17 for receiving the torque transfer projection 176 on the balance foot 168 in assembly, as shown in FIGS. 16 and 17. The sash stiles 134 and 136 are spaced from the jambs 142 and 144 by the pads 178 on the lower sash guide structure 166. Fins 180 are provided on the lower sash guide structure 166 for guiding the sash 26 during pivoting thereof. The tabs 182 serve to space the fin 184, best shown in FIG. 1, of the sash lift rail 138 from the fin 186 of the sill 40 of the outer frame member 138 to prevent metal to metal contact therebetween. The extension 190 of the lower sash guide member 166 provides stability and strength for the lower sash guide member 166.

The balance foot member 168, as shown in FIG. 15, has a recess 192 in the lower end thereof for receiving the the pivot portion 172 of the lower sash guide member 166, with the projection 176 of the balance foot member 168 extending within the recess 174 in the sash guide member. The recess 192 has an open side 194.

Further, as shown best in FIG. 16, the balance foot 16 has an opening 196 extending transversely therethrough which connects the recesses 198 and 200 on opposite sides thereof. The opening 196 and the recesses 198 and 200 receive the offset end 202 of sash balance ribbon 202 therein, as shown in FIG. 16, whereby the sash balance ribbon 202 may be installed and removed from the sash balance foot member 168 without tools. The sash balance foot member 168 further includes the projection 204 thereon which extends behind lip 206 of the frame jamb member 44 in assembly. The projection 204 eliminates twist of the sash balance foot with a sash balance secured thereto, as shown in FIG. 16, and with the lower sash guide member 166 not assembled therewith.

With the lower sash guide member 166 assembled with the sash balance foot member 168, torque is transferred to the window sash 26 from the sash balance foot member 168 through the lower sash guide member 166 assembled with the balance foot 168 due to the interaction of the torque transfer projection 176 and the pivot portion 172 of the balance foot 168 and lower sash guide member 166.

With the sash balance foot 168 and the lower sash guide member 166 assembled with each other and positioned within the sash stile 136 and the jamb 44 of the frame portion 36, on pivoting of the movable sash 26 out of the plane of the window frame 12 about the sash lift rail 138, after initial lifting of the sash 26 to clear the sill 40 and fixed check rail 46, the pivot portion 172 of lower sash guide member 166 is turned at an angle to the position thereof shown in FIG. 17, whereby a portion of the arcuate part of the cross section thereof extends out of the open side 94 of the sash balance member 168. The other side of the sash balance member 168 is accordingly moved into contact with the edge 206 of the sash stile 44 shown best in FIG. 2, while the arcuate portion of the pivot portion 172 is engaged with the edge 208 of the frame jamb 44, whereby the balance foot 168 and lower sash guide member 166 are secured in a predetermined position along the jamb members 42 and 44 during relative pivotal movement thereof.

The tilt release and upper sash guide structure 162 includes the upper sash guide member 210 and the tilt release member 164 shown best in FIG. 12. The upper sash guide member 210 includes the generally rectangular lower end portion 212 having the aligned notches 214 on opposite sides thereof for receiving the bearing bosses 216 of the tilt release member 164 and the generally flat portion 218 adapted to be secured within the stiles 134 and 136 at the upper edges of the movable sash 26 of the prime window structure 22. The lower portion of the sash guide member 210 is positioned within the sash stile 136 as shown best in FIG. 14 with the tabs 220 and abutments 222 thereon receiving the edges 224 and 226 of the sash stile 136 shown best in FIG. 2 therebetween. The sash guide member 210 is secured to the sash stile by convenient means such as the screw 240 extending through the opening 242 and sash stile 136 into sash check rail 132.

The tilt release member 164 includes the bearing bosses 216 on opposite sides thereof which are received in the notches 214 in the sash guide member 210 in assembly. The bottom end 228 of the tilt release member 164 extends within the rectangular lower end portion 212 of the upper sash guide member 210 and bears against the inner wall 230 of the sash stile to limit the pivotal movement of the tilt release member 164 in assembly.

Guide fins 232 are provided at the other end of the tilt release member 164, and as shown best in FIG. 13, with the tilt release member 164 in assembly with the upper sash guide member 210 and pivoted toward the sash jamb 44, the fins 232 extend within the sash jamb 44 and serve to guide the upper edge of the movable sash 26 of the prime window 22 in movement within the plane of the window frame 12 between the head 38 and sill 40 on the inner frame portion 36. The tilt release member 164 may be pivoted about the pivot bosses 216 thereof on grasping of the operating tab 234 to move the guide fins 232 out of the jamb 44, whereby tilting of the movable sash 26 out of the plane of the window is permitted. The beveled side members 236 provided on the tilt release member 164 serve to guide the tilt release member 164 in the movement of the fins 232 into and out of the jamb 44. The tilt release member 164 is biased into engagement with the jamb 44 by convenient means such as the spring 244 operable between the locating projections 246 and 248 on the sash guide member and tilt release member 210 and 164, respectively, as shown.

The storm window 28 includes the storm window frame 250 including head, stiles, center bar members 252, 254 and 256 having the cross section shown best in FIGS. 1 and 2. The fixed sash 30 is secured between the head 252, side stiles 254 which are the same on both sides of the sash 30 and bottom extrusion 258 by glazing members 260 having the cross section shown best in FIGS. 1 and 2. The bottom extrusion 258 has the cross section as shown best in FIG. 1, and is secured to the storm window center bar 256 by convenient means such as screws, not shown.

The movable sash 32 of the storm window 28 again includes a head 262, bottom lift rail 270, side stiles 264 and 266 secured together to form a rectangular frame. The glass panel 272 is secured in the movable window sash 32, again by the glazing members 274 having the cross section as shown best in FIGS. 1 and 2. The movable sash 32 moves in the plane of the window frame 12 between the head 52 and sill 54 of the outer frame portion 50 along the jambs 56 and 58 thereof.

The movable sash 26 of the prime window 22 and the movable sash 32 of the storm window 28 may be moved in the plane of the window 10 independently, or they may be selectively coupled for simultaneous movement in the plane of the window 10 by the sash coupler structure 276 shown best in FIG. 1. The sash coupler structure 276 includes a sash coupler member 278 having the cross section illustrated in FIG. 1 which is secured to the sash lift rail 138 by convenient means such as the screw 280.

As shown, the sash coupler member 278 includes a recess 282 in the free end thereof for selectively receiving the portion 284 of the lift rail 270 of the movable sash 32 of the storm window 28. The portion 284 of the lift rail 270 terminates in a hook 286 which cooperates with a similar hook 288 on the end of the portion 290 of the cross section of the sash coupler member 278. The sash coupler member 278 is sufficiently flexible so that the portion 290 thereof may be pivoted clockwise from its position shown to disengage the sash coupler from the portion 284 of the lift rail 270 so that the movable sash 26 of the prime window 22 and the movable sash 32 of the storm window 28 may be independently moved in the plane of the window structure.

With the sash coupler 278 engaged, as shown in FIG. 1, on raising of the prime window movable sash 26, the movable sash 32 of the storm window 28 is movable simultaneously therewith. In simultaneous movement, the hook portions 286 and 288 of the sash coupler member 278 and lift 270 engage to insure that the sash coupler member 278 remains connected to the portion 284 of the lift rail 270 during upward movement of the window sash 26 and 32 simultaneously.

When the sash coupler member 278 is uncoupled from the portion 284 of the lift rail 270, it may be readily reengaged by movement of the prime window movable sash 26 downwardly so as to move the sash coupler member 278 downwardly past the portion 284 of the lift rail 270, whereby the portion 290 thereof is cammed over the portion 284 of the lift rail 270 so that the portion 284 of the lift rail 270 enters the recess 282 in the sash coupler member 278.

As indicated above, when it is desired to disengage the movable sash 26 and 32 so that they may be moved independently, the sash 26 is first moved upwardly from its position shown in FIG. 1 so that the portion 290 of the sash coupler member 278 is exposed and the member 290 is rotated clockwise to disengage the hooks 86 and 88 and to permit the movement of the sash coupler member 278 completely past the portion 284 of the sash lift rail 270.

The sash coupler member 278 may be of any desired length in the longitudinal dimension of the lift rails 138 and 270 and preferably is two or three inches long.

Figure 9:
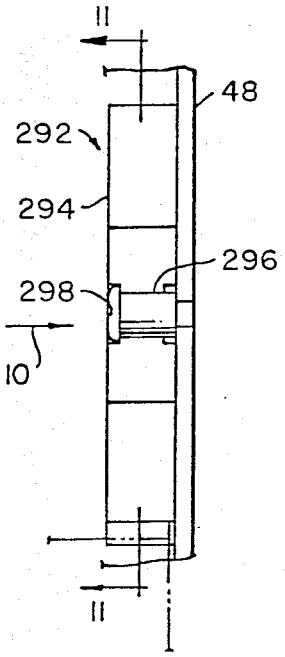
FIG. 9 is a front elevation view of sash lock structure constructed in accordance with the invention on the window structure of FIGS. 1 and 2.
Figure 10:
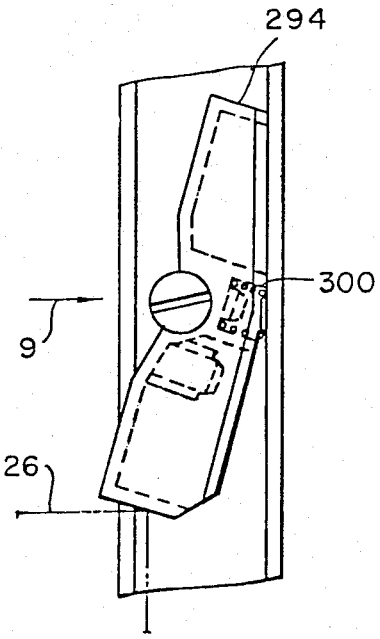
FIG. 10 is a side elevation view of the sash lock structure illustrated in FIG. 9, taken in the direction of arrow 10 in FIG. 9, showing the sash lock structure in a sash locked position.
Figure 11:
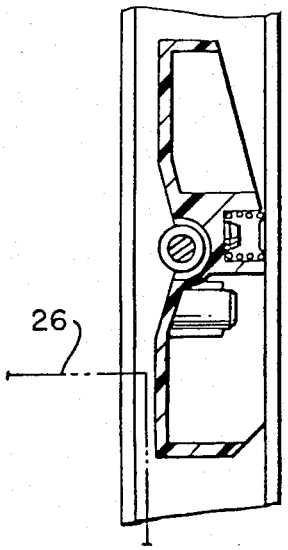
FIG. 11 is a section view of the sash lock structure illustrated in FIG. 9 taken substantially on the line 11—11 of FIG. 9 and showing the sash lock structure in longitudinal section.

Sash lock structure 292, shown best in FIGS. 9–11, is provided to selectively prevent movement of the movable sash 26 of the prime window 22 out of a fully closed position as illustrated in FIG. 1. The sash lock structure 292 includes the sash lock member 294 having the configuration shown in FIGS. 9–11, the pivot sleeve 296, mounting screw 298 and bias spring 300.

The sash lock structure 292, as shown in FIGS. 9–11, is mounted on the surface 304 of the jamb adapter 48 immediately above the fixed check rail 46 of the inner frame portion 36. The sash lock member 294 is secured to the jamb adapter 48 by means of the screw 298 passing through the pivot sleeve 296 into the jamb adapter 48.

As shown in FIG. 11, with the sash lock member 294 installed and in the pivoted position illustrated, the movable sash 26 may move past the sash lock member 294 in its movement between the head 38 and sill 40 of the inner frame portion 36. However, with the sash lock member 294 pivoted clockwise about the pivot sleeve 296 into the position shown in FIG. 10, the bottom of the sash lock member 294 will engage the end of the sash check rail 132 to prevent opening movement of the movable window sash 26.

The sash lock member 294 is biased by spring 300 as shown in FIG. 10 to remain in either the locking position shown in FIG. 10 or the unlocking position as shown in FIG. 11, after being placed in either position. Thus, the bias spring 300 is an over-center spring which, with the sash lock member 294 in the position shown in FIG. 11, urges the lock member in a counterclockwise direction. On pivoting of the sash lock member 294 into the position shown in FIG. 10, the spring 300 assumes a different position with respect to the center of the pivot sleeve 296, whereby the force of the spring 300 tends to move the sash lock member 294 clockwise.

The sash lock structure 292 as shown is manually operable. In a contemplated modification, the spring 300 is positioned below the pivot axis so that the spring 300 urges the sash lock member 294 into a locking position automatically as the sash 26 passes the member 294. Also, the sash lock structure may be positioned approximately three inches above the closed sash 26 to provide prowler proof ventilation.

Figure 18:
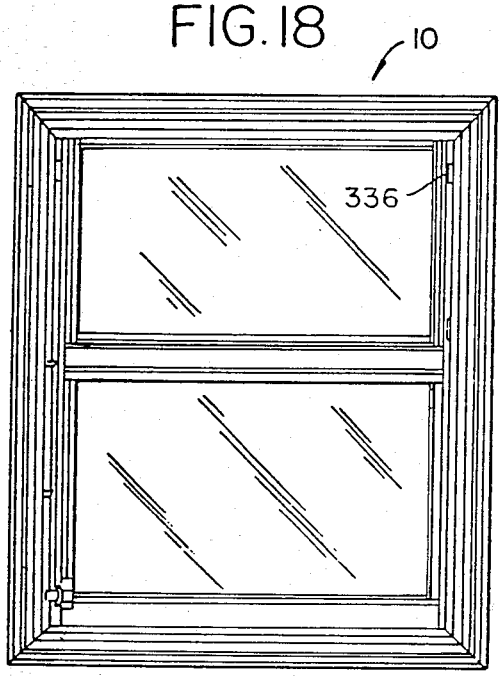
FIG. 18 is an inside front view of the window structure illustrated in FIGS. 1 and 2, including sash lock, pendulum lock, sash ejector and sash ejector preventer structure in assembly therewith.
Figure 19:
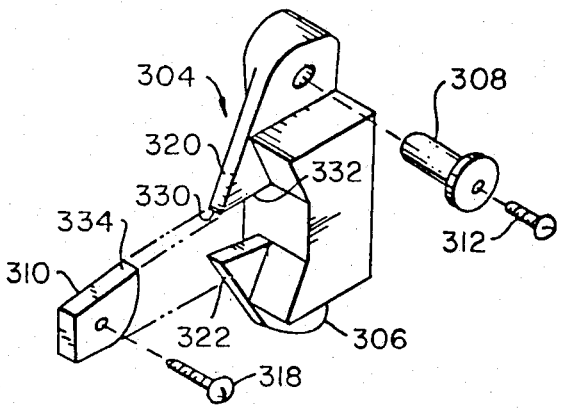
FIG. 19 is an exploded perspective view of pendulum lock structure constructed in accordance with the invention.
Figure 20:
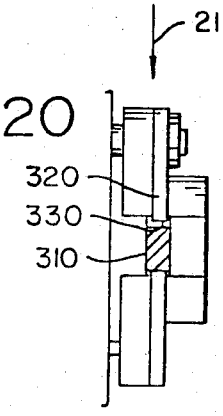
FIG. 20 is a front elevation view of the pendulum member of the pendulum lock structure illustrated in FIG. 19, taken substantially on the line 20—20 in FIG. 22, and showing the pendulum lock structure installed on the window structure of FIGS. 1 and 2.
Figure 21:
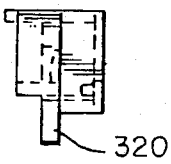
FIG. 21 is an end view of the pendulum structure illustrated in FIG. 20, taken in the direction of arrow 21 in FIG. 20.

The pendulum lock structure 304 illustrated best in FIG. 19 includes a pendulum member 306, a pivot sleeve 308, and a camming and locking tab 310. The pendulum member 306 may be mounted on the window structure 10 on either the right or the left side thereof on the surface 314 of the movable sash, sash stile 134, and as shown in FIG. 18 is mounted in the lower left hand corner by means of the pivot sleeve 308 and screw 312 shown best in FIG. 2. The locking and camming tabs 310 are provided at selected positions along the length of the lower half of the jamb member 42 and are secured to the surface 316 thereof by convenient means such as the screw 318. The pendulum member 306 as shown in FIGS. 19–21 includes the camming surfaces 320 and 322 thereon engageable with the tab 310 on movement of the sash 26 to move the pendulum member 306 past the tab 310.

Figure 22:
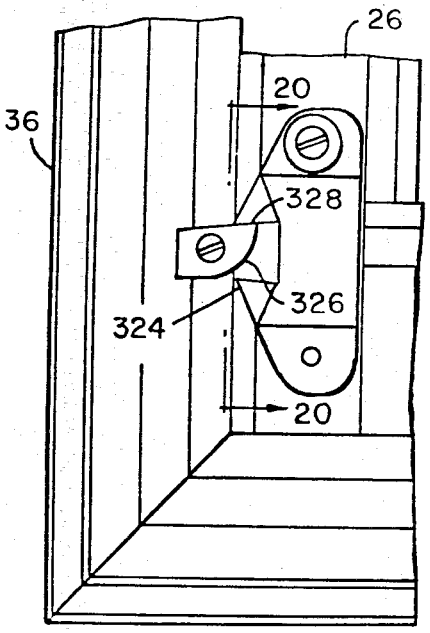
FIG. 22 is an enlarged view of the lower left corner of the window structure in FIG. 18, showing the pendulum lock structure of FIG. 19 secured thereto.
Figure 23:
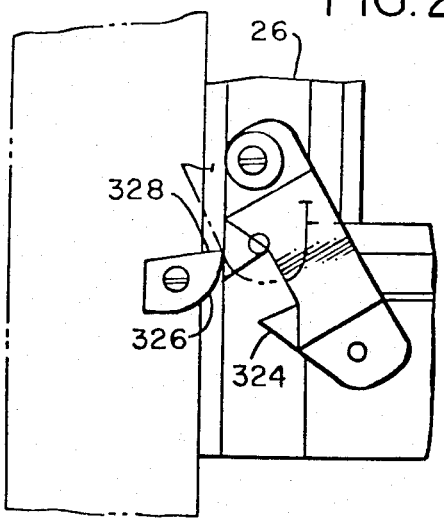
FIG. 23 is a view of the pendulum lock structure similar to that illustrated in FIG. 22, showing the pendulum member in a pivoted position.

In operation of the pendulum lock structure 304, with the movable sash 26 in a fully closed position as shown in FIGS. 1 and 22 in the inner frame portion 36, the pendulum member is first cammed in a counterclockwise direction due to engagement of the point 324 with the surface 326 of the tab, whereby the pendulum member 306 is allowed to move past the tab 310 during opening movement of the sash 26. On reaching the next tab 310 on the window structure 10, the surface 320 of the pendulum member 306 would engage the surface 326 on the tab to again cause the pendulum member to pivot counterclockwise and permit movement of the sash in an opening direction. Thus, neither the pendulum member 306 nor any of the tabs 310 associated therewith interfere with opening movement of the movable sash 26.

However, on downward movement of the sash 26, the surface 322 of the pendulum member 306 first comes into engagement with the point 328 on a tab 310, whereby the pendulum member 306 is again rotated in a clockwise direction. After this pivotal movement of the pendulum member 306 with the sash proceeding downwardly, one of two things may occur. If the sash is being moved downward fast enough, the counterclockwise rotation of the pendulum member 306 will cause the pendulum member 306 to remain in a pivoted counterclockwise position a sufficient time for the point 330 of the pendulum member 306 to proceed below the point 328 of the tab 310. In such case, the tab 310 will offer no interference with the downward movement of the sash in the frame portion 36. If, however, the downward movement of the sash 26 is slow enough so that the pendulum member 306 rotates clockwise under its own weight to place the point 330 of the pendulum member 306 over the point 328 of the tab 310 before they have passed each other in the downward movement of the sash 26, the surfaces 332 and 334 of the pendulum member 306 and tab 310 will come into contact to prevent further downward movement of the sash. Thus, the sash may be selectively retained in any of the selected positions at which the tab 310 has been positioned on the frame portion 36.

In this regard, it will be noted that no movement other than upward and downward movement of the sash 26 is required to open the sash 26 and secure it at a pre-selected position and to subsequently close the sash. Further, no member not securely fastened to the window structure are used in the pendulum lock operation and indeed the members of the pendulum lock structure need not be handled during such operation.

Figure 24:
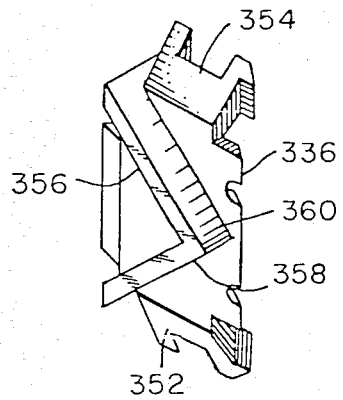
FIG. 24 is a perspective view of the sash ejector member for use with the window structure of FIGS. 1 and 2.
Figure 28:
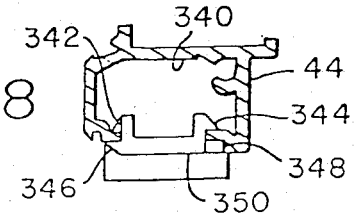
FIG. 28 is a partial section view of the jamb structure illustrated in FIG. 27, showing the sash ejector member in assembly therewith, taken substantially in the direction of arrow 28 in FIG. 27.

Sash ejector structure 336 is positioned at each upper corner of the inner frame portion 36 as shown in FIG. 18. The sash ejector structure 336, as shown in perspective in FIG. 24, is positioned within the recess 340 in the jamb member 44 at the upper end thereof adjacent the head member 38. The sash ejector 336 receives the edges 206 and 208 of the jamb member 44 shown in FIG. 2 between the barbed portions 342 and 344 and the extensions 346 and 348 of the body portion 350 thereof, as best shown in FIG. 28. As shown best in FIG. 24, the opposite ends of the sash ejector 336 have inclined surfaces 352 and 354 thereon, while structure 356 provides inclined plane surfaces 358 and 360 extending outwardly from the body portion 350 of the sash lock member 336, as best shown in FIG. 24.

Figure 27:
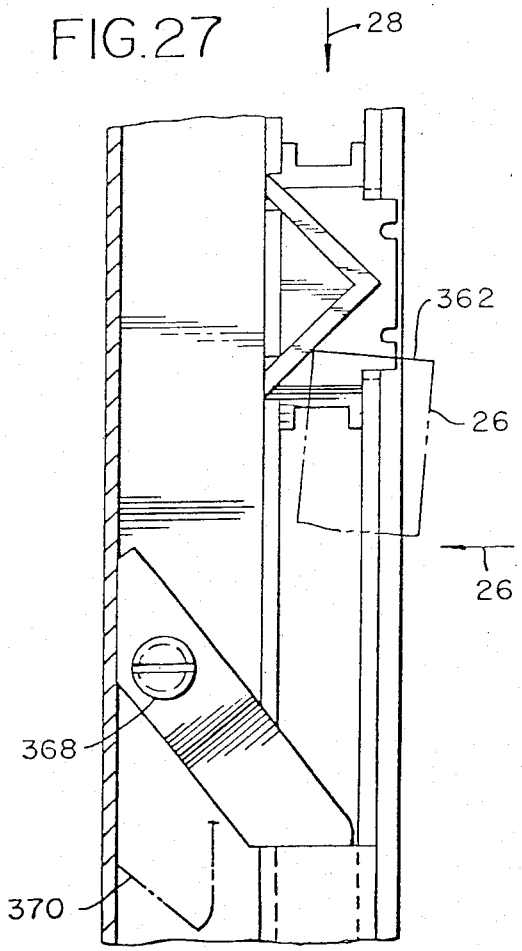
FIG. 27 is a partial section view of the jamb structure of the window structure illustrated in FIGS. 1 and 2, again showing the sash ejector member of FIG. 24 and the sash ejector preventer structure of FIG. 25 in assembly therewith, taken in the direction of arrow 27 in FIG. 26.

With the sash ejector structure 336 installed at the top of the jambs of the window frame portion 36 at opposite sides of the window structure 10 as shown in FIG. 18, when the movable sash 26 is moved upwardly in the plane of the window frame 12, guided by the balance foot and lower sash guide structure 160 shown in FIG. 15 and by the tilt release and upper sash guide 162 shown in FIG. 12, the tilt release members 164 at opposite sides of the sash 26 first engages the inclined surfaces 352 and 354 on opposite sides of the sash 26 so that the guide fins 232 are cammed out of the jamb members 42 and 44. The top 362 of the head 132 of sash 26 then engages the inclined surfaces 358 and 360 at the opposite ends of head 132 and the sash 26 is cammed out of the plane of the frame of the window structure 10 as shown in FIG. 27. Such operation is especially useful with high windows or with horizontal windows where one side is too high to permit ready manual operation of the sash release structure.

When it is desired to pivot the sash 26 from the window structure 10, the sash is merely moved to its uppermost position, at which time the sash 26 is automatically caused to pivot about its lift rail out of the plane of the window frame, after which the sash may then be rotated to a desired angle for cleaning, removal, or the like, without the necessity of manually actuating the tilt release mechanism and manually initially tilting the sash out of the plane of the window frame.

Figure 25:
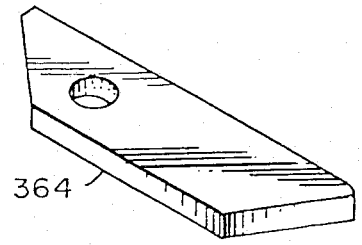
FIG. 25 is a perspective view of a sash ejector preventer member for use with the window structure of FIGS. 1 and 2.
Figure 26:
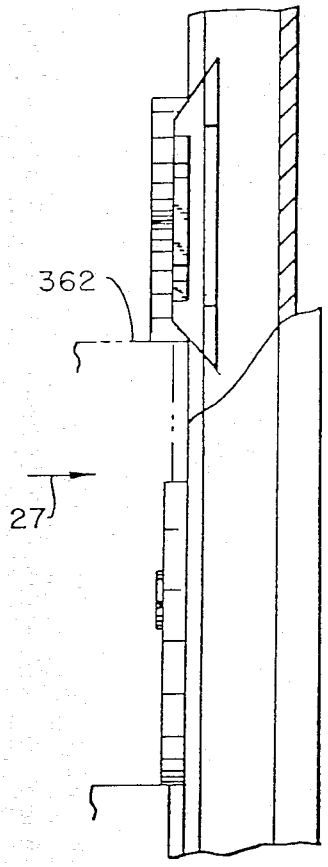
FIG. 26 is a partially broken away front elevation view of a portion of the jamb of the window frame of the window structure illustrated in FIGS. 1 and 2, showing the sash ejector member of FIG. 24 and the sash ejector preventer of FIG. 25 in assembly therewith, taken in the direction of arrow 26 in FIG. 27.

A sash ejector preventer 364, illustrated in perspective in FIG. 25, is secured to the surface 366 of the jamb adapter 49 illustrated in FIG. 2 immediately below the sash ejector 336 as shown in FIGS. 26 and 27. The sash ejector preventer 364, as shown in FIG. 25, is pivotally mounted on the jamb adapter by convenient means such as screw 368. A pivot sleeve may be utilized if desired.

When it is desired to operate the sash ejector structure, the sash ejector preventer 364 is pivoted into the position shown by the broken lines 370, FIG. 27. When it is desired that the sash ejector structure not operate, the sash ejector preventer 364 is pivoted into the position shown in solid lines in FIG. 27, whereby the upward movement of the sash 26 is prevented before the top 362 of the head 132 of sash 26 reaches the sash ejector. Undesired automatic ejection of the sash on raising of the sash 26 may thus be prevented.

The screen 34 of the window structure 10, as shown in FIGS. 29–34, includes a frame having a head, two side stiles and a bottom 372, 374, 376 and 378, two upper corner members 380 and 382 and two lower corner members 384 and 386, a screen panel 388 and spline means 390.

The head and bottom members and the side stiles 372, 378, 374 and 376 have the same cross section as shown in FIG. 30 and are slightly bowed prior to assembly as shown in FIG. 31 so that their center is further from the center of the finished screen than the ends thereof. The upper corner members 380 and 382 have the configuration shown in FIG. 32, while the lower corner members 384 and 386 have the configuration shown in FIG. 33.

In assembly, the top, bottom and side stiles are secured together by the corner members 380, 382, 384 and 386 as shown in FIG. 34. The assembled frame is then placed in a jig so that the top, bottom and sides are held straight while the screen panel 388 is secured thereto by means of the spline members 390 inserted in the recess 392 around the inner periphery of the frame.

Subsequently, on removal of the screen 30 from the jig, the top, bottom and sides tend to return to their slightly bowed position, as shown in FIG. 31, while the screen is retained in a tightly stretched condition. The screen 30 may then be lifted by the lift tabs 394 and 396 on the bottom corner brackets 384 and 386, and the head 372 thereof may be positioned behind the portion 394 of the member 256 of the storm window frame 250. The screen is centered and held in position by the spring tabs 400 and 402 on the upper corner brackets 380 and 382 of the screen 30. The bottom 378 of the screen 30 is then positioned behind the staked-out abutments 404 on the sill 54 of the outer frame portion 50 which secure the screen 30 in position.

While one embodiment of the invention has been considered in detail, it will be understood that other embodiments and modifications of the window structure disclosed are contemplated. It is the intention to include all such embodiments and modifications as are defined by the appended claims within the scope of the invention.

What I claim as my invention is:

1. Tilt release and upper sash guide structure for use with a tiltable window sash having two ends and a tilting and a pivoted edge guided in movement between frame jamb members including a sash guide member having a hollow generally rectangular lower end including an open front and back and a generally flat rectangular upper end at the back thereof having a notch extending into the generally rectangular lower end from the back thereof which sash guide member is adapted to be secured to the sash adjacent the tilting edge of the sash at one end thereof and a tilt release member having pivot bosses extending from one end thereof on both sides of the tilt release member positioned within the notches in the sash guide member to mount the tilt release member on the sash guide member for pivotal movement about the one end of the tilt release member, guide fins on the tilt release member at the other end thereof extending away from the sash guide member engageable with a frame jamb member for guiding the sash in movement in the plane of the frame, resilient means positioned between the sash guide member and tilt release member for urging the other end of the tilt release member away from the sash guide member and into engagement with the frame jamb and an operating tab on the other end of the tilt release member for facilitating grasping and pivoting of the other end of the tilt release member toward the sash guide member to remove the guide fins from contact with the frame and permit pivoting of the window sash about the pivoted edge thereof.

2. Structure as set forth in claim 1, wherein the sash guide member further includes abutments at the bottom of the lower end, at each side thereof extending outwardly and tapering on the outer surface thereof from the back toward the front of the sash guide member so as to provide a triangular configuration for the abutments and terminating short of the front of the sash guide member and tabs extending outwardly from the opposite sides of the sash guide member from the front of the sash guide member in back to front and end to end spaced relation to the abutments on the sash guide member to facilitate securing of the sash guide member to the sash.

3. Structure as set forth in claim 1, and further including tapered side portions on the tilt release members adjacent the other end thereof on both sides of the tilt release member for guiding the tilt release member in pivoted movement toward and away from the frame to guide the guide fins into engagement with the frame.

4. Structure as set forth in claim 1, and further including an extension on the bottom of the tilt release member extending from the one end thereof at the bearing bosses in a direction opposite the other end of the tilt release member engageable with the sash on pivotal movement of the other end of the tilt release member away from the other end of the sash guide member for limiting the pivotal movement of the tilt release member with the tilt release and sash guide members in assembly on a sash.

5. Structure as set forth in claim 1, wherein the resilient means for urging the other end of the tilt release member away from the other end of the sash guide member comprises locating projections on the front of the upper end of the sash guide member and on the back of the other end of the tilt release menber and a helical spring extending therebetween the opposite ends of which are positioned over the locating projections.

6. Structure as set forth in claim 1, wherein the frame includes inner and outer portions and a thermal barrier between the inner and outer portions securing the inner and outer portions of the frame together.

7. Structure as set forth in claim 6, wherein the inner portion of the frame is a prime window frame including the sash therein and the outter portion of the frame is a storm window frame.

8. Tilt release and upper sash guide structure for use with a tiltable window sash having two ends and a tilting and a pivoted edge guided in movement between frame jamb members including a sash guide member having a hollow generally rectangular lower end including an open front and back and a generally flat rectangular upper end at the back thereof having a notch extending into the generally rectangular lower end from the back thereof which sash guide member is adapted to be secured to the sash adjacent the tilting edge of the sash at one end thereof and a tilt release member having pivot bosses extending from one end thereof on both sides of the tilt release member positioned within the notches in the sash guide member to mount the tilt release member on the sash guide member for pivotal movement about the one end of the tilt release member guide fins on the tilt release member at the other end thereof extending away from the sash guide member engageable with a frame jamb member for guiding the sash in movement in the plane of the frame, resilient means positioned between the sash guide member and tilt release member for urging the other end of the tilt release member away from the sash guide member and into engagement with the frame jamb and an operating tab on the other end of the tilt release member for facilitating grasping and pivoting of the other end of the tilt release member toward the sash guide member to remove the guide fins from contact with the frame and permit pivoting of the window sash about the pivoted edge thereof wherein the sash guide member further includes abutments at the bottom of the lower end, at each side thereof extending outwardly and tapering on the outer surface thereof from the back toward the front of the sash guide member so as to provide a triangular configuration for the abutments and terminating short of the front of the sash guide member and tabs extending outwardly from the opposite sides of the sash guide member from the front of the sash guide member in back to front and end to end spaced relation to the abutments on the sash guide member to faciliate securing of the sash guide member to the sash, the tilt release member includes tapered side portions adjacent the other end and on both sides thereof for guiding the tilt release member in pivoted movement toward and away from the frame to guide the guide fins into engagement with the frame, and an extension on the bottom of the tilt release member extending from the one end thereof at the bearing bosses in a direction opposite the other end of the tilt release member engageable with the sash on pivotal movement of the other end of the tilt release member away from the other end of the sash guide member for limiting the pivotal movement of the tilt release member with the tilt release and sash guide members in assembly on a sash and wherein the resilient means for urging the other end of the tilt release member away from the other end of the sash guide member comprises locating projections on the front of the upper end of the sash guide member and on the back of the other end of the tilt release member and a helical spring extending therebetween the opposite ends of which are positioned over the locating projections.

* * * * *